US010818451B2

(12) United States Patent
Vaishnavi et al.

(10) Patent No.: US 10,818,451 B2
(45) Date of Patent: Oct. 27, 2020

(54) ELECTRICAL SWITCHING MECHANISM CONTROL APPARATUS

(71) Applicant: Eaton Intelligent Power Limited, Dublin (IE)

(72) Inventors: Romil Vaishnavi, Jammu and Kashmir (IN); Warren Clift Sipe, Cleveland, TN (US); Arthur James Jur, Cleveland, TN (US)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 16/270,875

(22) Filed: Feb. 8, 2019

(65) Prior Publication Data

US 2020/0258701 A1 Aug. 13, 2020

(51) Int. Cl.
*H01H 21/22* (2006.01)
*H01H 21/36* (2006.01)

(52) U.S. Cl.
CPC ..... *H01H 21/22* (2013.01); *H01H 21/36* (2013.01); *H01H 2225/006* (2013.01); *H01H 2225/01* (2013.01)

(58) Field of Classification Search
CPC ... H01H 21/22; H01H 21/36; H01H 2225/006
USPC ..... 200/42.01, 49, 50.01
See application file for complete search history.

(56) References Cited

U.S. PATENT DOCUMENTS

2008/0124960 A1* 5/2008 Jur ..... H01R 25/142 439/114
2009/0278635 A1* 11/2009 Lindsey ..... H01H 1/2058 335/10
2017/0229261 A1* 8/2017 Rota Martir ..... H01H 21/22

* cited by examiner

*Primary Examiner* — Nguyen Tran
*Assistant Examiner* — Iman Malakooti
(74) *Attorney, Agent, or Firm* — Benesch, Friedlander, Coplan & Aronoff LLP

(57) ABSTRACT

An electrical switching apparatus includes a first pole unit, a second pole unit, and a busbar assembly interconnecting the first pole unit with the second pole unit in series or in parallel. A first mechanism is configured to switch the first pole unit between its open and closed conditions. A second mechanism is configured to switch the second pole unit between its open and closed conditions. An actuating assembly is configured to actuate the first and second mechanisms to switch the first and second pole units from their open conditions to their closed conditions simultaneously, and to switch the first and second pole units from their closed conditions to their open conditions simultaneously.

17 Claims, 6 Drawing Sheets

ELECTRICAL SWITCHING MECHANISM CONTROL APPARATUS

TECHNICAL FIELD

This technology relates to an electrical switching mechanism that opens and closes pole units having electrical contacts.

BACKGROUND

An electrical switch, such as a safety switch or disconnect, may be housed in an enclosure. The switch may include pole units having electrical contacts. A switching mechanism may be connected with the pole units to switch the pole units between open and closed conditions manually by the use of a handle at the exterior of the enclosure.

SUMMARY

An apparatus includes a first pole unit, a second pole unit, and a busbar assembly interconnecting the first pole unit with the second pole unit in series or in parallel. A first mechanism is configured to switch the first pole unit between its open and closed conditions. A second mechanism is configured to switch the second pole unit between its open and closed conditions. An actuating assembly is configured to actuate the first and second mechanisms to switch the first and second pole units from their open conditions to their closed conditions simultaneously, and to switch the first and second pole units from their closed conditions to their open conditions simultaneously.

DETAILED DESCRIPTION

Figure 1:
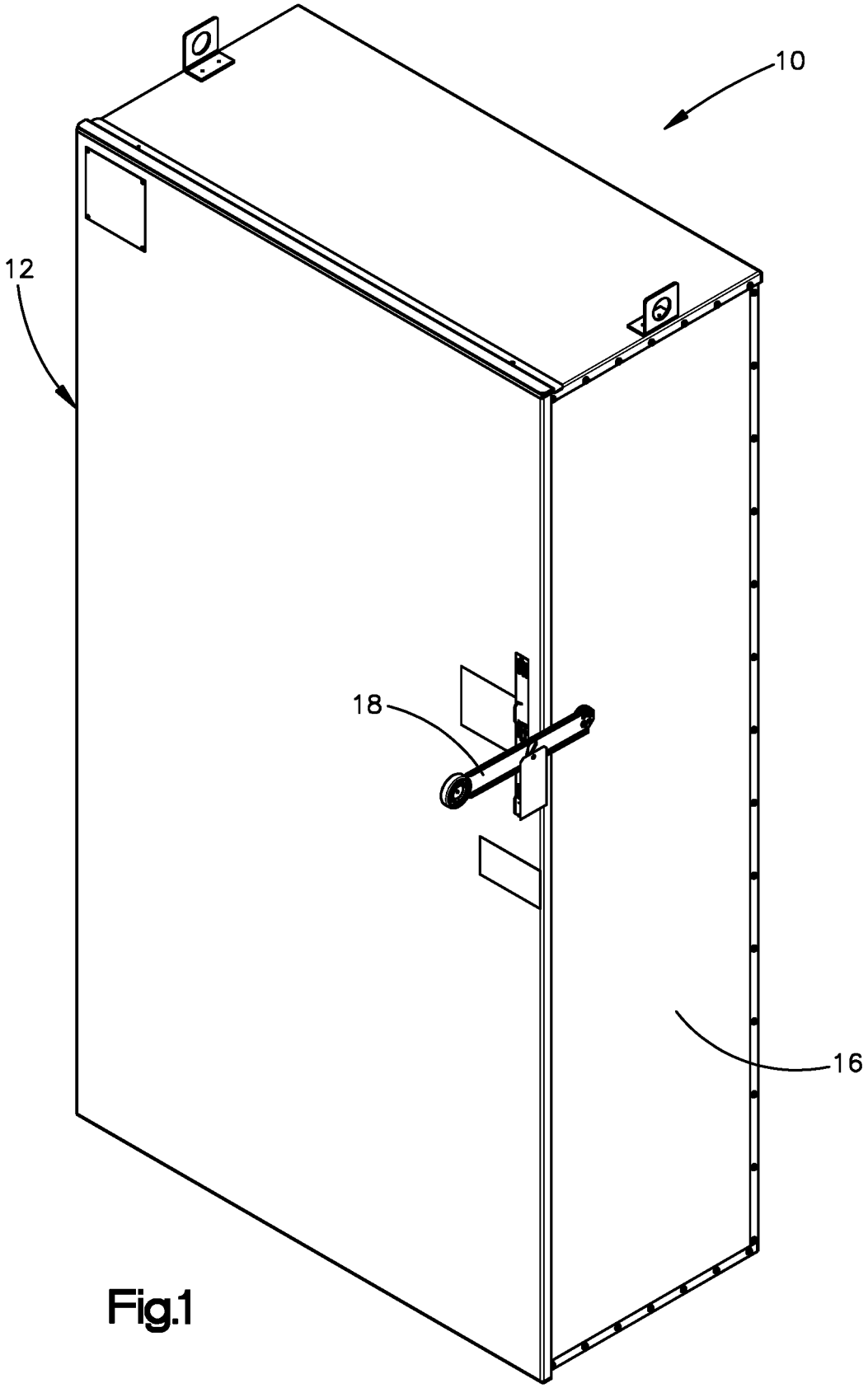
FIG. 1 is a front perspective view of an electrical enclosure containing a switching apparatus.

The embodiments illustrated in the drawings have parts that are examples of the elements recited in the claims. The illustrated embodiments thus include examples of how a person of ordinary skill in the art can make and use the claimed invention. They are described here to meet the enablement and best mode requirements of the patent statute without imposing limitations that are not recited in the claims. One or more of the elements of one embodiment may be used in combination with, or as a substitute for, one or more elements of another as needed for any particular implementation of the claimed invention.

As shown in FIG. 1, an apparatus 10 includes an enclosure 12 for electrical safety switches. The enclosure 12 has a door 14 at the front side, and has a side panel 16 beside the door 14. A manually operated handle 18 at the exterior of the enclosure 12 projects forward from the side panel 16 past the door 14. The handle 18 is connected with switches inside the enclosure 12 to open and close the switches upon movement of the handle 18 pivotally between open and closed positions.

Figure 2:
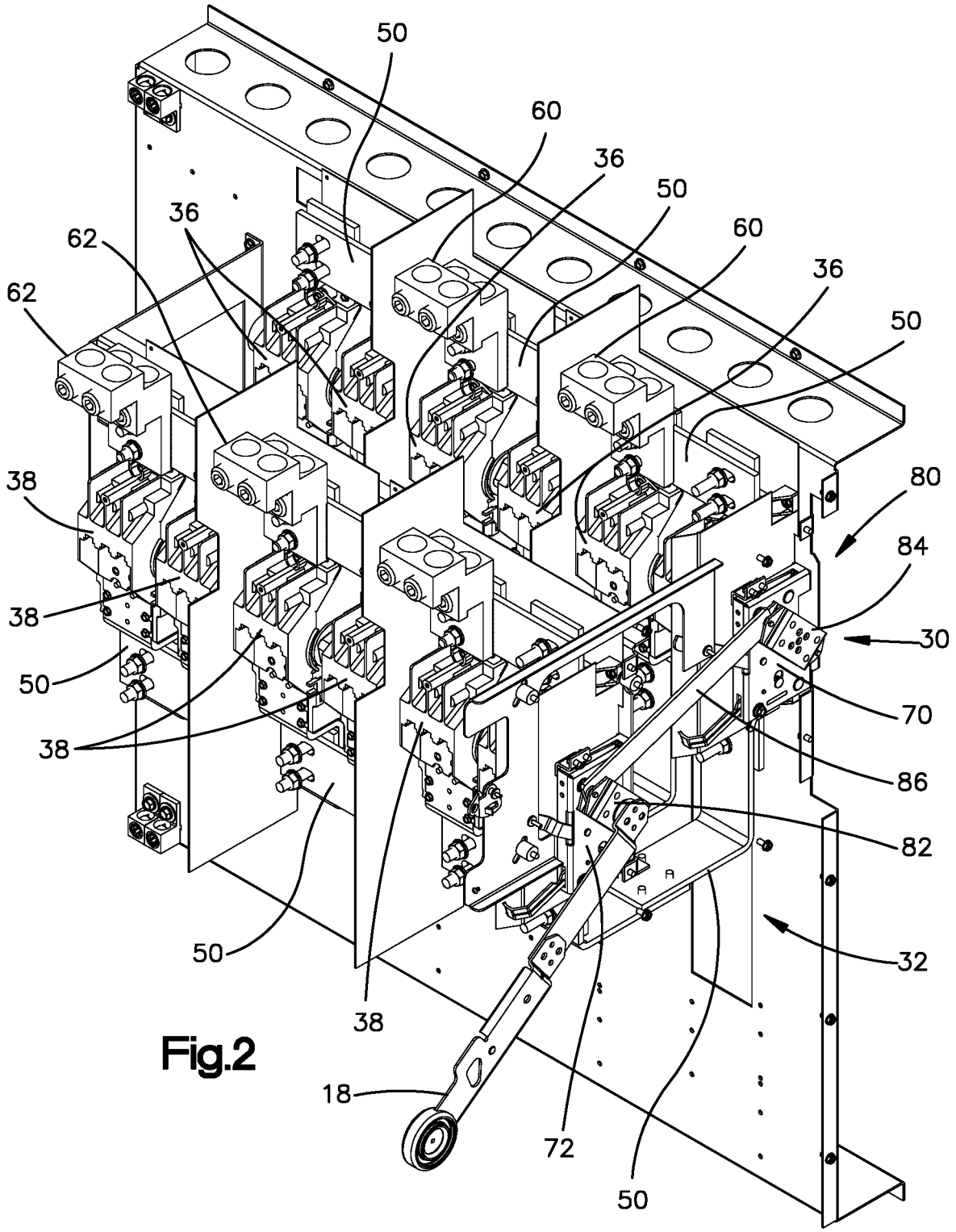
FIG. 2 is perspective view showing components contained within the enclosure.

The enclosure 12 contains multiple switching assemblies which, in the illustrated example, include a pair of switching assemblies 30 and 32 as shown in FIG. 2. The first switching assembly 30 includes a row of first pole units 36. The second switching assembly 32 includes a row of second pole units 38. As known in the art, each individual pole unit 36 and 38 includes an assembly of electrical contacts that are switchable between open and closed conditions.

The first switching assembly 30 further includes an actuating shaft (not shown) that reaches along and through the row of first pole units 36. As further known in the art, such an actuating shaft is linked with the electrical contacts in the first pole units 36 to shift them between their open and closed conditions upon rotation of the shaft between open and closed positions. The second switching assembly 32 similarly includes an actuating shaft reaching along and through the row of second pole units 38. The actuating shaft in the second switching assembly 32 is linked with the electrical contacts in the second pole units 38 to shift them between their open and closed conditions upon rotation of that shaft between open and closed positions. The pole units 36 and 38 in the illustrated embodiment are arranged with their actuating shafts parallel to one another. Additionally, the switching assemblies 30 and 32 are configured and engaged with the pole units 36 and 38 such that all of the pole units 36 and 38 have the same condition, either open or closed, at any given time.

Figure 3:
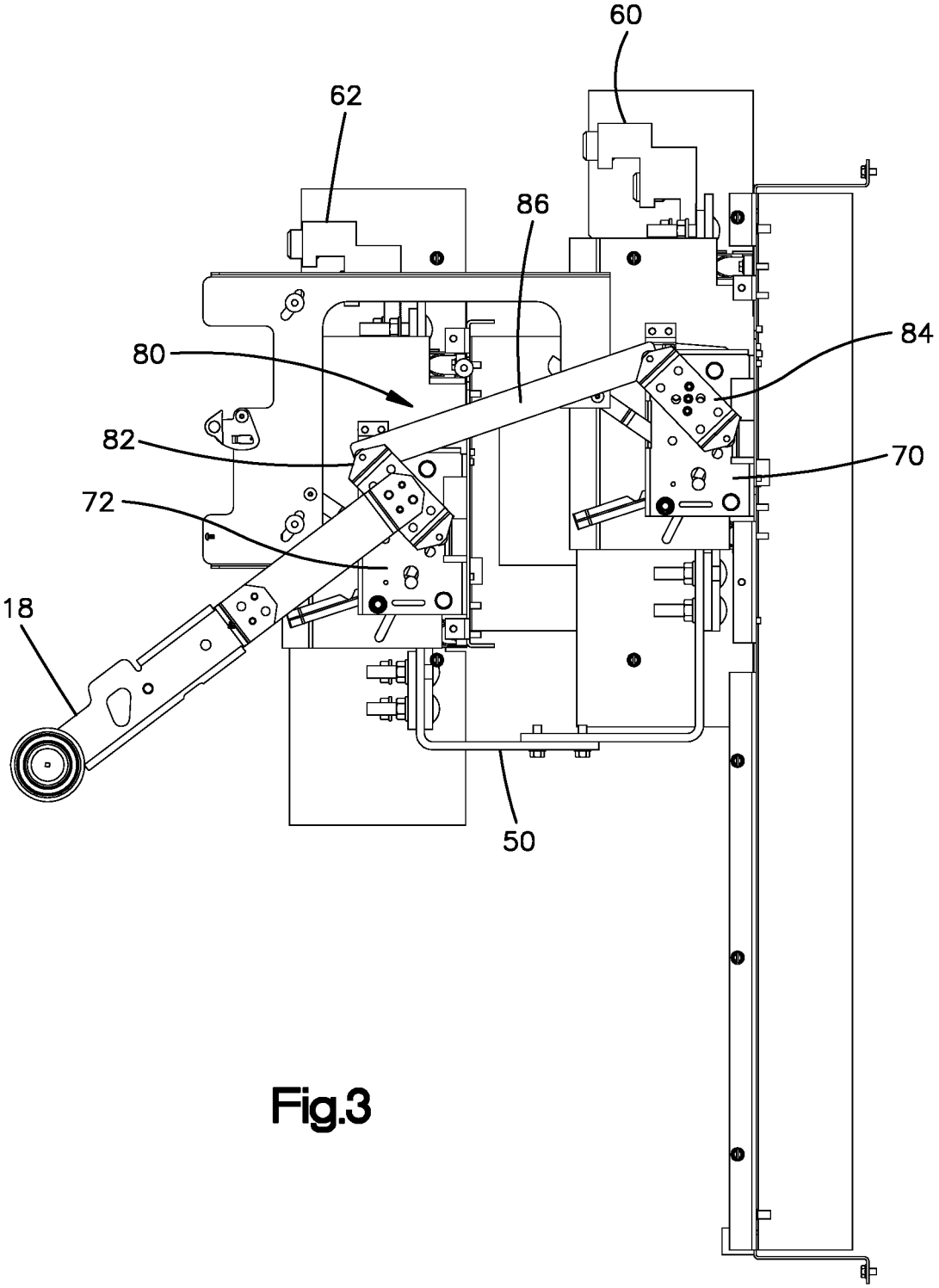
FIG. 3 is a side view of components shown in FIG. 2.

Each of the first pole units 36 is electrically connected with a corresponding one of the second pole units 38. These connections are made by busbar assemblies 50. Each busbar assembly 50 connects one of the first pole units 36 with a corresponding one of the second pole units 38. In the embodiment of FIGS. 2 and 3, each busbar assembly 50 connects the first pole unit 36 with the second pole unit 38 in series.

Also shown in FIGS. 2 and 3 are lugs for connection with electrical power lines. These include line side lugs 60 and load side lugs 62, some of which are omitted for clarity of illustration. Each line side lug 60 is mounted on a busbar assembly 50 at the line side of the pole units 36 and 38 that are connected by that busbar assembly 50. Each load side lug 62 is mounted on a busbar assembly 50 at the load side of the pole units 36 and 38 that are connected by that busbar assembly 50. In this arrangement, the lugs 60 and 62 at each busbar assembly 50 are also connected in series with one another.

A first switching mechanism 70 is associated with the row of first pole units 66. The first switching mechanism 70 includes a rotatable shaft that is splined or otherwise connected to the actuating shaft for switching the electrical contact assemblies in the first pole units 36, as described above. In a similar manner, a second switching mechanism 72 is associated with the row of second pole units 68. The second switching mechanism 72 likewise includes a rotatable shaft that is splined or otherwise connected to the actuating shaft at the second pole units 38.

The handle 18 is supported on the second switching mechanism 72 for movement pivotally about a horizontal axis 75. The axis 75 is aligned with the actuating shaft reaching through the second pole units 68, and the second switching mechanism 72 is configured to rotate the actuating shaft between open and closed positions upon movement of the handle 18 pivotally between its open and closed positions.

An actuating assembly 80 reaches from the second switching mechanism 72 to the first switching mechanism 70 to connect the handle 18 with the first switching mechanism 70. This includes a link 82 that is mounted on the second switching mechanism 72 to rotate about the axis 75 together with both the handle 18 and the shaft in the second switching mechanism 72. The handle is connected to the link 82 through an aperture in the side panel 16 of the enclosure 12, as shown in FIG. 1. Another link 84 is mounted on the first switching mechanism 70 to rotate the shaft in the first switching mechanism 70 upon rotation of that link 84. An additional link 86 is pivotally coupled to the other two links 82 and 84 to rotate those two links 82 and 84 together under the influence of the pivoting handle 18.

In use, movement of the handle 18 pivotally back and forth between the open and closed positions causes the actuating assembly 80 to rotate the interconnected shafts in the switching mechanisms 70 and 72 simultaneously, and thereby to shift the electrical contact assemblies in the pole units 66 and 68 back and forth between the open and closed conditions simultaneously.

The handle 18 is shown in the open position in FIGS. 1 and 3. When the handle 18 is moved pivotally upward to the closed position, the links 82 and 84 at the switching mechanisms 70 and 72 are rotated clockwise as viewed in the drawings. The interconnected shafts are then rotated equally in the same direction so that the two rows of pole units 36 and 38 are switched from their open conditions to their closed conditions simultaneously. When the handle 18 is moved pivotally back downward from the closed position to the open position, the links 80 and 82 are rotated counterclockwise back to the positions of FIGS. 1 and 3, and the interconnected shafts are rotated equally in the same direction so that the two rows of pole units 36 and 38 are switched back from their closed conditions to their open conditions simultaneously.

As noted above, the pole units 36 and 38 have the same condition such that all of the pole units 36 and 38 are in the open condition, or all of them are in the closed condition, at any given time. By connecting the common-condition pole units 36 and 38 in series with one another, each busbar assembly 50 enables the corresponding series of contact assemblies to break greater voltages across the greater sum of opened gaps when the contact assemblies are all shifted to their open conditions.

Figure 4:
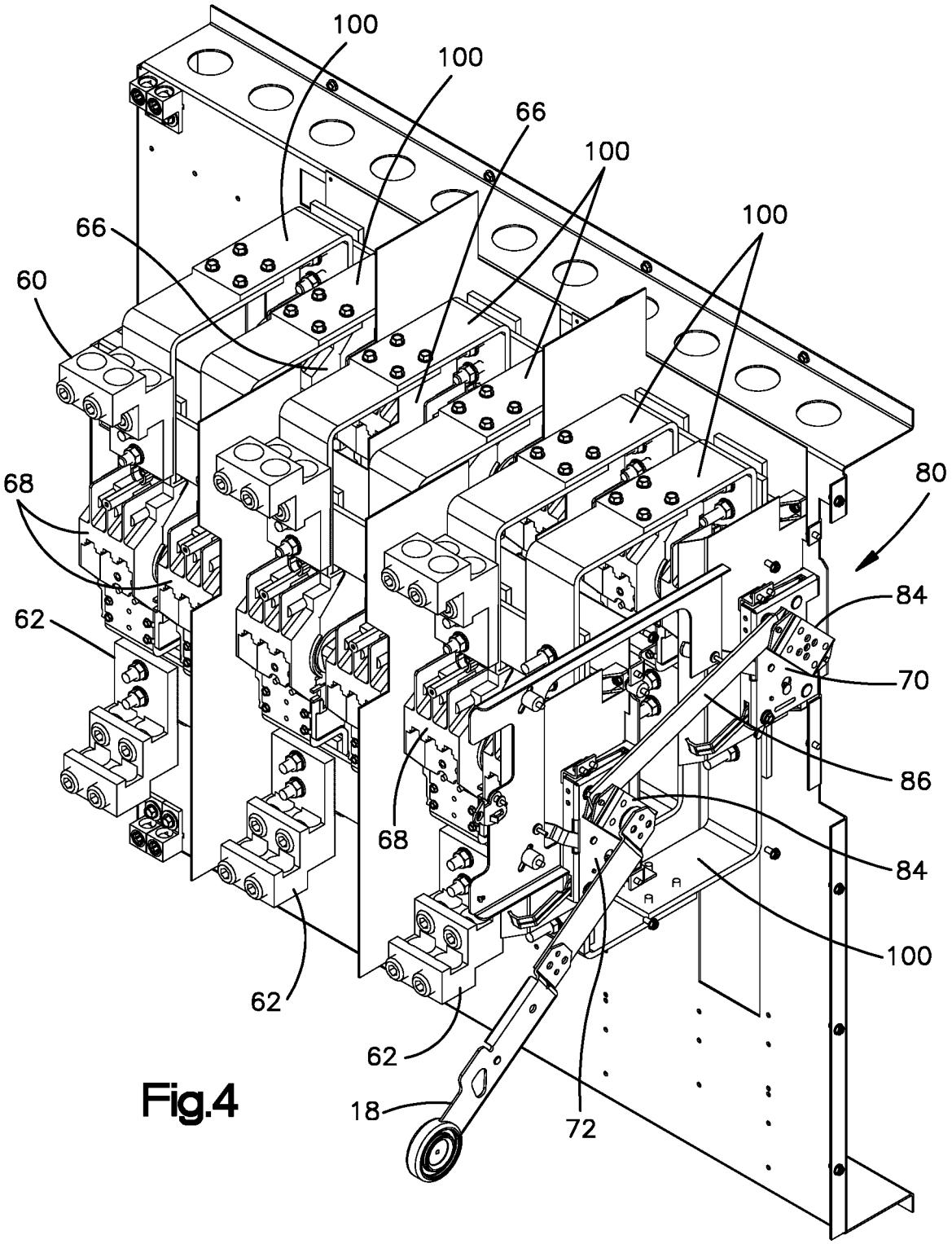
FIG. 4 is a perspective view similar to FIG. 2 showing parts of an alternative embodiment.

An alternative embodiment is illustrated in FIG. 4. This embodiment includes parts that are the same or substantially the same as corresponding parts of the embodiment of FIGS. 1-3. Such corresponding parts have the same reference numbers in FIGS. 1-3 and 4. The embodiment of FIG. 4 thus includes a manual actuating assembly 80 interconnecting a handle 18 with a pair of switching mechanisms 70 and 72 for simultaneously opening and closing electrical contact assembles in two rows of pole units 66 and 68. These pole units 66 and 68 also have a common condition such that all of the pole units 66 and 68 are in the open condition, or all of them are in the closed condition, at any given time. However, the busbar assemblies 100 of FIG. 4 differ from the busbar assemblies 50 of FIGS. 2 and 3. In the embodiment of FIG. 4, each busbar assembly 100 interconnects the corresponding pair of pole units 66 and 68 in parallel rather than in series. By connecting common-condition pole units 66 and 68 in parallel with one another, each busbar assembly 100 enables the corresponding series of contact assemblies to carry currents across the greater sum of closed contacts when the contact assemblies are all in their closed conditions.

Figure 5:
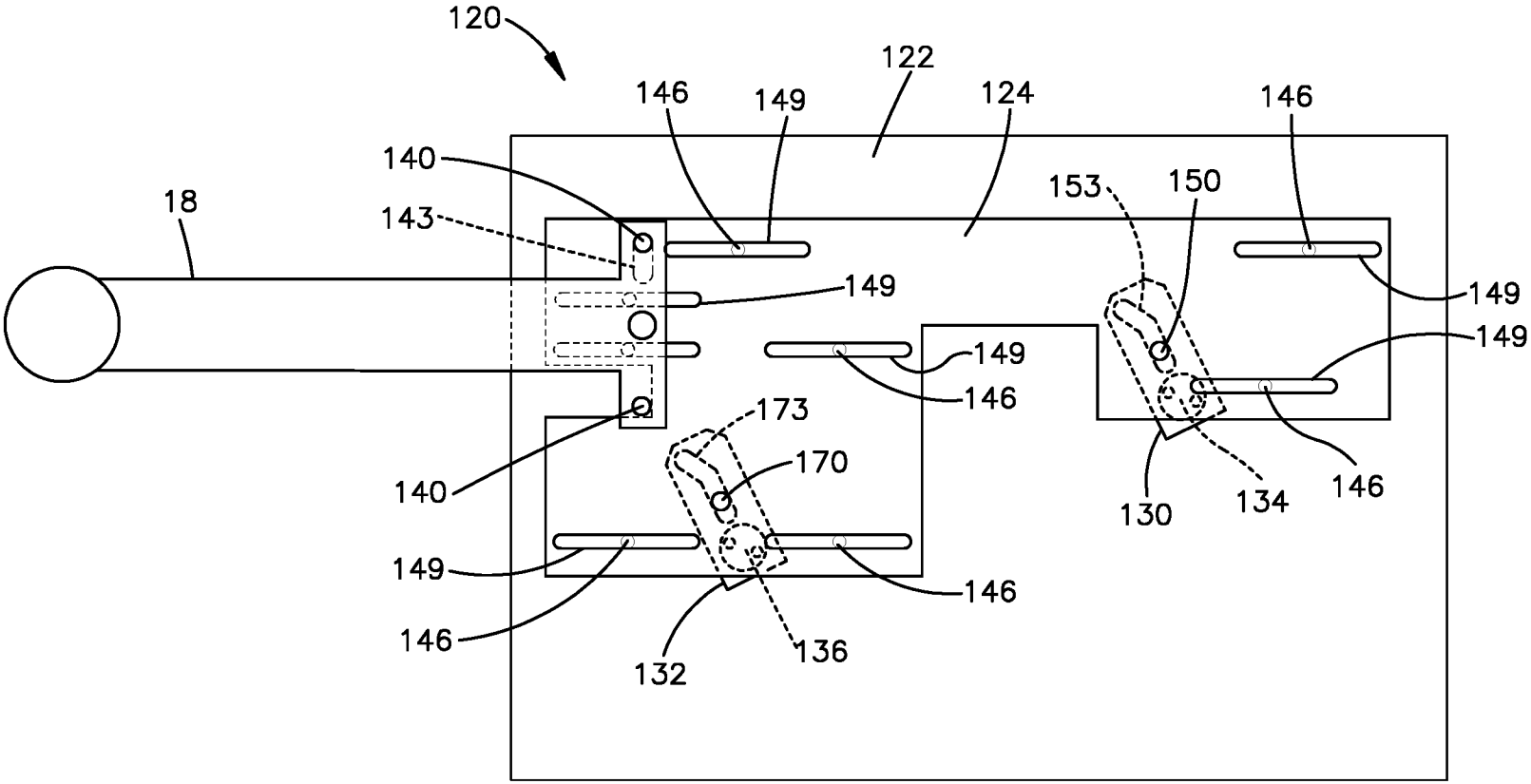
FIG. 5 is a side view of parts of another alternative embodiment.
Figure 6:
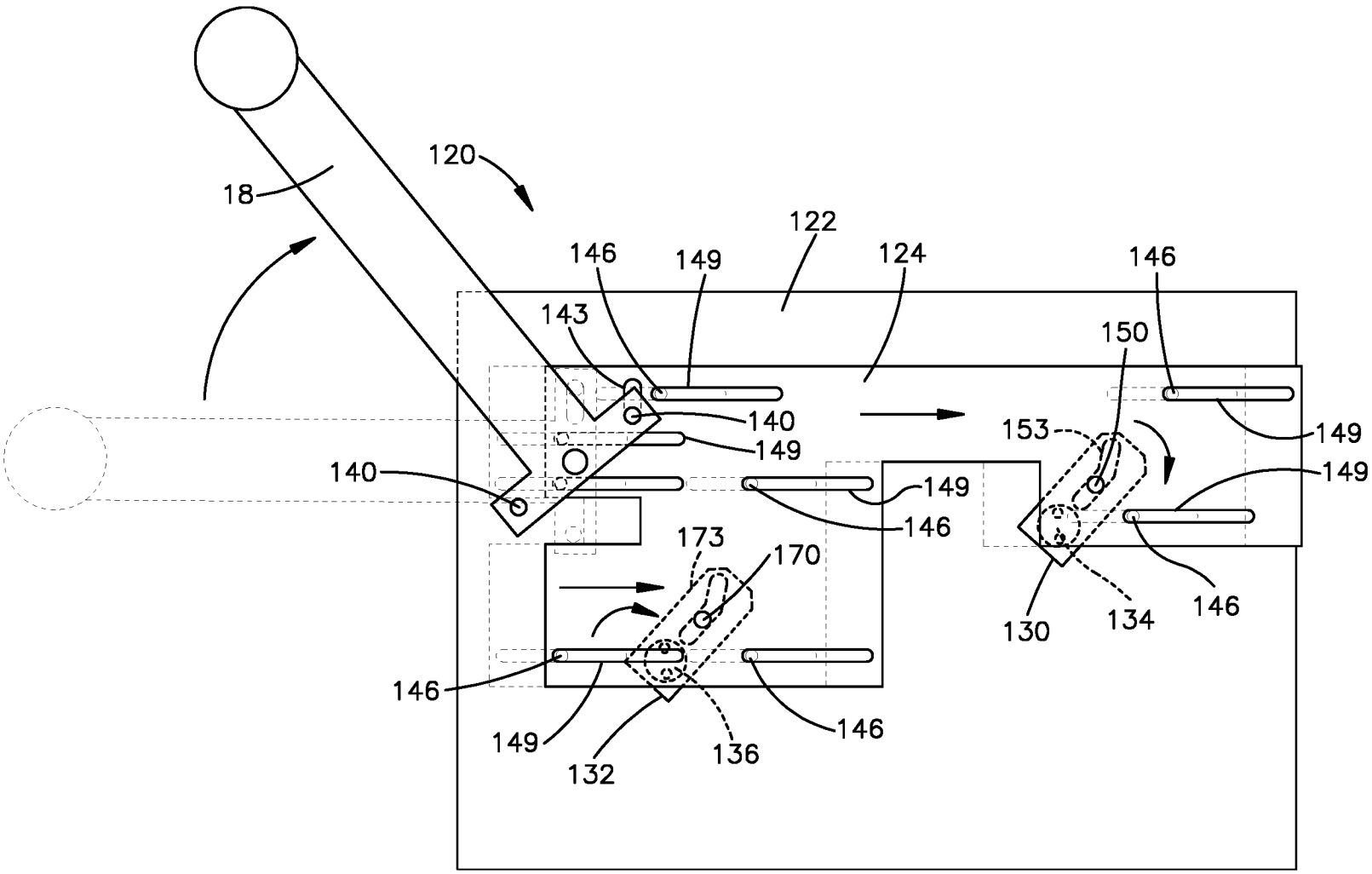
FIG. 6 is a view similar to FIG. 5, showing parts in different positions.

Another embodiment has an alternative manual actuating assembly 120 in place of the assembly 80 described above. As shown in FIGS. 5-6, the alternative linkage 120 in this example includes a stationary panel 122 that is fixed to the side panel 16 (FIG. 1) inside the enclosure 12. A sliding panel 124 is supported on the stationary panel 122. A pair of pivotal links 130 and 132 are fixed to rotatable shafts 134 and 136. These shafts 134 and 136 are parts of switching mechanisms like the switching mechanisms 70 and 72 of FIGS. 2-3.

Pins and slots are provided on the handle 18, the sliding panel 124, and the links 130 and 132. The pins and slots are configured to slide the panel 124 back and forth upon movement of the handle 18 between the open and closed positions. Such sliding movement of the panel 124 moves the links 130 and 132 pivotally to rotate the shafts 134 and 136 in the switching mechanisms. This switches the associated pole units between open and closed conditions as described above.

In the illustrated example, the pins and slots include a pair of pins 140 on the handle 18. One of those pins 140 is received in a slot 143 in the sliding panel 124. An array of pins 146 on the stationary panel 122 are received in corresponding slots 149 in the sliding panel 124. A pin 150 on the sliding panel 124 is received in a slot 153 in the first link 130. When the handle 18 is moved from the position of FIG. 5 to the position of FIG. 6, the pin 140 on the handle 18 moves within the slot 143 on the sliding panel 124 to slide the panel 124 to the right as viewed in the drawings. The pin 150 on the sliding panel 124 then moves against the first link 130 within the slot 153 to move the link 130 pivotally as shown in FIG. 6. The shaft 134 at the associated switching mechanism is rotated accordingly. Movement of the handle 18 from the position of FIG. 6 back to the position of FIG. 5 similarly causes oppositely directed movements to rotate the shaft 134 in the opposite direction.

Another pin 170 on the sliding panel 124 is received in a slot 173 in the second link 132. When the handle 18 is moved from the position of FIG. 5 to the position of FIG. 6 so as to move the sliding panel 124 to the right, the pin 170 moves against the second link 132 within the slot 173 to move that link 132 pivotally as shown in FIG. 6. The shaft 136 at the second link 132 is thus rotated simultaneously and in the same direction equally with the shaft 134 at the first link 130, and the associated pole units are switched accordingly.

Movement of the handle 18 back and forth between the positions of FIGS. 5 and 6 thus rotates the shafts 134 and 136 at the two links 130 and 132 back and forth equally in the same direction. In this manner, the shafts 134 and 136 at the switching mechanisms are rotated to switch the associated pole units from their open conditions to their closed conditions simultaneously, and to switch the associated pole units from their closed conditions to their open conditions simultaneously.

This written description sets for the best mode of carrying out the invention, and describes the invention so as to enable a person of ordinary skill in the art to make and use the invention, by presenting examples of the elements recited in the claims. The detailed descriptions of those elements do not impose limitations that are not recited in the claims, either literally or under the doctrine of equivalents.

What is claimed is:

1. An apparatus comprising:

a row of first pole units switchable between open and closed conditions;

a row of second pole units switchable between open and closed conditions, wherein the row of second pole units is parallel to and spaced apart from the row of first pole units;

multiple busbar assemblies interconnecting the parallel rows of pole units, wherein each of the busbar assemblies connects one of the first pole units with one of the second pole units;

a first shaft reaching along the row of first pole units, wherein the first shaft is engaged with the first pole units to open and to close the first pole units simultaneously upon rotation of the first shaft;

a second shaft parallel to and spaced apart from the first shaft, wherein the second shaft reaches along the row of second pole units and is engaged with the second pole units to open and to close the second pole units simultaneously upon rotation of the second shaft; and a linkage interconnecting the first and second shafts to open and close the first and second pole units simultaneously by rotating the first and second shafts simultaneously in common rotational directions.

2. An apparatus as defined in claim 1, further comprising a manually pivotal handle connected with the second shaft to rotate the second shaft upon pivotal movement of the handle, whereby the linkage rotates the first and second shafts together in response to pivotal movement of the handle.

3. An apparatus as defined in claim 1, wherein each of the busbar assemblies connects one of the first pole units with one of the second pole units in series.

4. An apparatus as defined in claim 3, wherein each of the busbar assemblies connects one of the first pole units with one of the second pole units in parallel.

5. An apparatus as defined in claim 1, further comprising a manually pivotal handle connected with the second shaft to rotate the second shaft upon pivotal movement of the handle, whereby the linkage rotates the first and second shafts together in response to pivotal movement of the handle.

6. An apparatus as defined in claim 5, further comprising an enclosure containing the first and second pole units, the busbar assemblies, the first and second shafts, and the linkage, wherein the enclosure has an exterior wall, and the handle is located outward of the exterior wall.

7. An apparatus as defined in claim 6, wherein the enclosure has a side panel and a door, and the handle projects from the side panel past the door.

8. An apparatus comprising:

a first pole unit switchable between open and closed conditions;

a second pole unit switchable between open and closed conditions;

a busbar assembly connecting the first pole unit with the second pole unit in series or in parallel;

a first mechanism configured to switch the first pole unit between its open and closed conditions;

a second mechanism configured to switch the second pole unit between its open and closed conditions; and an actuating assembly configured to actuate the first and second mechanisms to switch the first and second pole units from their open conditions to their closed conditions simultaneously, and to switch the first and second pole units from their closed conditions to their open conditions simultaneously; wherein:

the switching mechanisms include rotatable shafts that are operatively engaged with the pole units, and the actuating assembly is configured to rotate the shafts together in a common rotational direction; and the actuating assembly includes a panel supported for sliding movement, and the panel is coupled with the shafts to rotate the shafts in the common rotational direction in response to sliding movement of the panel.

9. An apparatus as defined in claim 8, wherein the busbar assembly interconnects the first pole unit with the second pole unit in series.

10. An apparatus as defined in claim 8, wherein the busbar assembly interconnects the first pole unit with the second pole unit in parallel.

11. An apparatus as defined in claim 8, wherein the actuating assembly includes a manually pivotal handle supported on the second switching mechanism, and is configured to transmit movement of the handle from the second switching mechanism to the first switching mechanism.

12. An apparatus as defined in claim 8, wherein the actuating assembly is configured for manual operation.

13. An apparatus as defined in claim 12, further comprising an enclosure containing the first pole unit, the second pole unit, the busbar assembly, the first mechanism, and the second mechanism, wherein the enclosure has an exterior wall, and the actuating assembly includes a manually operable handle located outward of the exterior wall.

14. An apparatus comprising:

multiple first pole units switchable between open and closed conditions;

multiple second pole units switchable between open and closed conditions;

multiple busbar assemblies, each of which connects one of the first pole units with one of the second pole units in series;

a first mechanism configured to open and to close the first pole units simultaneously;

a second mechanism configured to open and to close the second pole units simultaneously; and an actuating assembly configured to actuate the first and second mechanisms to switch the first and second pole units from their open conditions to their closed conditions simultaneously, and to switch the first and second pole units from their closed conditions to their open conditions simultaneously; wherein:

the mechanisms include rotatable shafts that are operatively engaged with the pole units, and the actuating assembly is configured to rotate the shafts together in a common rotational direction; and the actuating assembly includes a panel supported for sliding movement, and the panel is coupled with the shafts to rotate the shafts in in the common rotational direction in response to sliding movement of the panel.

15. An apparatus as defined in claim 14, wherein the actuating assembly includes a manually pivotal handle supported on the second switching mechanism, and is configured to transmit movement of the handle from the second switching mechanism to the first switching mechanism.

16. An apparatus comprising:

multiple first pole units switchable between open and closed conditions;

multiple second pole units switchable between open and closed conditions;

multiple busbar assemblies, each of which connects one of the first pole units with one of the second pole units in parallel;

a first mechanism configured to open and to close the first pole units simultaneously;

a second mechanism configured to open and to close the second pole units simultaneously; and an actuating assembly configured to actuate the first and second mechanisms to switch the first and second pole units from their open conditions to their closed conditions simultaneously, and to switch the first and second pole units from their closed conditions to their open conditions simultaneously; wherein the switching mechanisms include rotatable shafts that are operatively engaged with the pole units, and the actuating assembly is configured to rotate the shafts together in a common rotational direction; and the actuating assembly includes a panel supported for sliding movement, and the panel is coupled with the shafts to rotate the shafts in in the common rotational direction in response to sliding movement of the panel.

17. An apparatus as defined in claim 16, wherein the actuating assembly includes a manually pivotal handle supported on the second switching mechanism, and is configured to transmit movement of the handle from the second switching mechanism to the first switching mechanism.

* * * * *